US007708844B2

(12) United States Patent
Muramatsu et al.

(10) Patent No.: US 7,708,844 B2
(45) Date of Patent: May 4, 2010

(54) METHOD OF FORMING METALLIC GLASS

(75) Inventors: Naokuni Muramatsu, Nagoya (JP); Ken Suzuki, Handa (JP); Akihisa Inoue, Sendai (JP); Hisamichi Kimura, Watari-gun (JP)

(73) Assignees: NGK Insulators, Ltd., Nagoya-Shi (JP); Tohoku University, Sendai-Shi (JP)

( * ) Notice: Subject to any disclaimer, the term of this patent is extended or adjusted under 35 U.S.C. 154(b) by 728 days.

(21) Appl. No.: 11/628,122

(22) PCT Filed: May 27, 2005

(86) PCT No.: PCT/JP2005/009801

§ 371 (c)(1),
(2), (4) Date: Nov. 28, 2006

(87) PCT Pub. No.: WO2005/115653

PCT Pub. Date: Dec. 8, 2005

(65) Prior Publication Data

US 2008/0034796 A1 Feb. 14, 2008

(30) Foreign Application Priority Data

May 28, 2004 (JP) ..... 2004-160234

(51) Int. Cl.
*C22F 1/02* (2006.01)
*C22F 1/18* (2006.01)

(52) U.S. Cl. ..... 148/557; 148/562; 29/527.3

(58) Field of Classification Search ..... None
See application file for complete search history.

(56) References Cited

U.S. PATENT DOCUMENTS

| | | | | |
|---|---|---|---|---|
| 6,070,649 | A * | 6/2000 | Urlau et al. | 164/488 |
| 6,325,868 | B1 * | 12/2001 | Kim et al. | 148/403 |
| 2002/0072203 | A1 | 6/2002 | Shimokohbe et al. | |
| 2002/0092151 | A1 | 7/2002 | Sugiura et al. | |
| 2004/0166330 | A1 | 8/2004 | Shimokohbe et al. | |
| 2004/0166664 | A1 | 8/2004 | Shimokohbe et al. | |

FOREIGN PATENT DOCUMENTS

| | | |
|---|---|---|
| JP | 55-63676 | 5/1980 |
| JP | 02-175039 | 7/1990 |
| JP | 10-216920 | 8/1998 |
| JP | 10-296424 | 11/1998 |

(Continued)

OTHER PUBLICATIONS

Seiichi Hata et al., "Fabrication of Micro Structures using Thin Film Metallic Glass—Fabrication of Thin Film Metallic Glass and Micro-Forming using the Supercooled Liquid State", Journal of the Japan Society of Precision Engineering, vol. 66, No. 1, Jan. 5, 2000, pp. 96-97.

*Primary Examiner*—George Wyszomierski
(74) *Attorney, Agent, or Firm*—Burr & Brown

(57) ABSTRACT

A method for forming a metallic glass, which comprises a step of subjecting a metallic glass to a rough forming by die casting, to prepare a roughly formed article, and a step of heating the roughly formed article to a temperature region corresponding to an undercooled liquid thereof, followed by subjecting the heated article to warm press forming.

8 Claims, 7 Drawing Sheets

FOREIGN PATENT DOCUMENTS

| | | |
|---|---|---|
| JP | 2000-301316 | 10/2000 |
| JP | 2000-317900 | 11/2000 |
| JP | 2001-347351 | 12/2001 |
| JP | 2002-086258 | 3/2002 |
| JP | 2002-192294 | 7/2002 |
| JP | 2002-361399 | 12/2002 |
| JP | 2003-117647 | 4/2003 |
| JP | 2003-534925 | 11/2003 |
| JP | 2004-098125 | 4/2004 |
| WO | 01/94054 | 12/2001 |

* cited by examiner

FIG. 8A

| | PRE-FORMING | MELTING METHOD | MELTING TEMPERATURE (℃) | AMBIENT ATMOSPHERE | CASTING PRESSURE (Kg/cm2) | INJECTION SPEED (m/s) | CASTING THICKNESS (mm) | FINISHING FORMING | DIE HEATING | SURFACE ROUGHNESS (μm) |
|---|---|---|---|---|---|---|---|---|---|---|
| EXAMPLE 1 | DIE CASTING | HIGH FREQUENCY INDUCTION HEATING | 1,200 | VACUUM | 800 | 1.6 | 0.7 | WARM PRESSING | BUILT-IN HEATER | 0.07 |
| EXAMPLE 2 | DIE CASTING | HIGH FREQUENCY INDUCTION HEATING | 1,250 | N2 VENTILATION | 700 | 1.4 | 1.1 | WARM PRESSING | BUILT-IN HEATER | 0.4 |
| EXAMPLE 3 | DIE CASTING | YAG LASER | NOT MEASURABLE | Ar VENTILATION | 800 | 1.4 | 0.7 | WARM PRESSING | BUILT-IN HEATER | 0.3 |
| EXAMPLE 4 | DIE CASTING | YAG LASER | NOT MEASURABLE | He VENTILATION | 800 | 1.6 | 0.4 | WARM PRESSING | BUILT-IN HEATER | 0.4 |
| EXAMPLE 5 | DIE CASTING | HIGH FREQUENCY INDUCTION HEATING | 1,200 | Ar VENTILATION | 750 | 1.4 | 1.1 | WARM PRESSING | BUILT-IN HEATER | 0.4 |
| EXAMPLE 6 | DIE CASTING | YAG LASER | NOT MEASURABLE | N2 VENTILATION | 800 | 1.4 | 0.7 | WARM PRESSING | BUILT-IN HEATER | 0.2 |
| EXAMPLE 7 | DIE CASTING | YAG LASER | NOT MEASURABLE | Ar VENTILATION | 800 | 1.5 | 0.7 | WARM PRESSING | BUILT-IN HEATER | 4.9 |
| EXAMPLE 8 | DIE CASTING | YAG LASER | NOT MEASURABLE | Ar VENTILATION | 800 | 1.5 | 0.5 | WARM PRESSING | BUILT-IN HEATER | 1.2 |
| EXAMPLE 9 | DIE CASTING | YAG LASER | NOT MEASURABLE | Ar VENTILATION | 800 | 1.3 | 0.5 | WARM PRESSING | BUILT-IN HEATER | 0.4 |
| COMPARATIVE EXAMPLE 1 | DIE CASTING | HIGH FREQUENCY INDUCTION HEATING | NOT MEASURABLE | VACUUM | 800 | 1.4 | 0.7 | – | – | – |
| COMPARATIVE EXAMPLE 2 | – | – | – | – | – | – | – | WARM PRESSING | EXTERNAL HEATER | 0.4 |
| COMPARATIVE EXAMPLE 3 | METAL MOLD CASTING | HIGH FREQUENCY INDUCTION HEATING | 1,200 | VACUUM | – | – | 2 | – | – | – |
| COMPARATIVE EXAMPLE 4 | HIGH-PRESSURE INJECTION MOLDING | HIGH FREQUENCY INDUCTION HEATING | 1,200 | VACUUM | – | – | 0.8 | – | – | – |
| COMPARATIVE EXAMPLE 5 | MELT FORGING | ARC MELTING | 1,500 | VACUUM | – | – | 0.9 | – | – | – |

CONTINUE TO FIG. 8B

FIG. 8B

CONTINUE FROM FIG. 8A

| AMBIENT ATMOSPHERE | POWDER FILM | MOLDING TEMPERATURE (℃) | CASTING SPEED (mm/min) | PRESSURIZING PERIOD(min) | PRESS-FORMING SHAPE | MINIMUM WALL THICKNESS OF FINISHED ARTICLE (mm) | SURFACE ROUGHNESS OF FINISHED ARTICLE Ra(μm) | FINISHED SHAPE (DEGREE OF FILLING) | PRESENCE OR ABSENCE OF SURFACE DEFECT | MAINTENANCE OF AMORPHOUS CHARACTERISTIC |
|---|---|---|---|---|---|---|---|---|---|---|
| N2 | ABSENT | 450 | 1 | 2 | 3D CABINET, UNIFORM WALL THICKNESS | 0.6 | 0.05 | ○ | ABSENT | ○ |
| N2 | ABSENT | 450 | 1 | 2 | 3D CABINET, UNIFORM WALL THICKNESS | 0.5 | 0.04 | ○ | ABSENT | ○ |
| N2 | ABSENT | 450 | 2 | 1.5 | 3D CABINET, NONUNIFORM WALL THICKNESS | 0.5 | 0.05 | ○ | ABSENT | ○ |
| N2 | ABSENT | 450 | 2 | 1.5 | 3D CABINET, NONUNIFORM WALL THICKNESS | 0.3 | 0.05 | ○ | ABSENT | ○ |
| N2 | ABSENT | 450 | 2 | 1.5 | 3D CABINET, NONUNIFORM WALL THICKNESS | 0.8 | 0.04 | ○ | ABSENT | ○ |
| N2 | BN | 440 | 1.2 | 2 | 3D CABINET, NONUNIFORM WALL THICKNESS | 0.4 | 0.04 | ○ | ABSENT | ○ |
| N2 | ABSENT | 440 | 1.2 | 2 | 3D CABINET, NONUNIFORM WALL THICKNESS | 0.5 | 0.03 | ○ | ABSENT | ○ |
| ATMOSPHERE | ABSENT | 430 | 1.2 | 2 | 3D CABINET, NONUNIFORM WALL THICKNESS | 0.3 | 0.06 | ○ | ABSENT | ○ |
| ATMOSPHERE | BN | 430 | 1.2 | 2 | 3D CABINET, NONUNIFORM WALL THICKNESS | 0.3 | 0.05 | ○ | ABSENT | ○ |
| - | - | - | - | - | 3D CABINET, NONUNIFORM WALL THICKNESS | 0.7 | 0.07 | × | PRESENT | ○ |
| N2 | ABSENT | 450 | 1 | 20 | TRAY | 0.8 | 0.4 | × | PRESENT | ○ |
| - | - | - | - | - | 3D CABINET, UNIFORM WALL THICKNESS | 1.2 | 0.05 | × | PRESENT | × |
| - | - | - | - | - | 3D CABINET, UNIFORM WALL THICKNESS | 0.8 | 0.06 | × | PRESENT | × |
| - | - | - | - | - | 3D CABINET, UNIFORM WALL THICKNESS | 0.9 | 0.07 | × | PRESENT | × |

METHOD OF FORMING METALLIC GLASS

TECHNICAL FIELD

The present invention relates to a method of forming a metallic glass into a thin-wall component such as an electronic equipment cabinet.

BACKGROUND ART

Metallic liquid normally enters an extremely unstable state when cooled below a melting point, and is immediately crystallized to become crystallized metal. In this event, time for which a supercooled liquid can exist in an uncrystallized state where atoms are randomly arranged, i.e., a so-called "amorphous state," is estimated to be $10^{-5}$ seconds or less at a nose temperature of a continuous cooling transformation (CCT) curve. Specifically, this means that it is impossible to obtain amorphous alloys unless a cooling rate of $10^6$ K/s or more is achieved.

However, there has recently been invented metallic glass which undergoes clear glass transition and is not crystallized even at a cooling rate of 100 K/s or less since a supercooled liquid state is extremely stabilized in a specific alloy group including a zirconium base (see, for example, The June 2002 edition of Kinou Zairyou (Functional Materials), Vol. 22, No. 6, p.p.5-9; Non-patent Document 1).

Each of these metallic glasses has a wide temperature range (supercooled liquid temperature range) in which a supercooled liquid state can be maintained. For this reason, superplastic forming by means of viscous flow can be performed on each of the metallic glasses (see, for example, The July 2002 edition of Kinou Zairyou (Functional Materials), Vol. 22, No. 7, p.p. 5-8; Non-patent Document 2) under a condition that a temperature and a time period are not reached within the temperature range causing crystallization.

Additionally, it is known that a large-shaped amorphous alloy (a bulk metallic glass) can be manufactured directly from molten metal by any one of manufacturing methods such as a water quenching method, an arc melting method, a permanent mold casting method, a high-pressure injection molding method, a suction casting method, a mold-clamp casting method and a rotating-disc fiber manufacturing method (see, for example, The June 2002 edition of Kinou Zairyou (Functional Materials), Vol. 22, No. 6, p.p.26-31; Non-patent Document 3).

Metallic glasses manufactured by these manufacturing methods can provide mechanical properties even in large sizes, which may otherwise be lacking in crystalline alloys. The mechanical properties include a high strength and a low Young's modulus and a high elastic limit, which are inherent in the amorphous state. For this reason, the metallic glasses are expected to be widely put into practical use as structural materials.

Metallic glasses are originally suitable for application to thin-wall molded articles, such as an electronic equipment cabinet, for which three-dimensional shapes realizing high strengths and light weights are favored. There are, however, problems as described below with the above described manufacturing methods of obtaining large-shaped metallic glass components.

Firstly, the permanent mold casting method has the following problems. The general permanent mold casting method is a simple method with which molten metal is simply poured into a molding cavity of a die. Therefore, depending on the shape of the component, it is difficult to avoid shape losses due to insufficient run of spreading of the molten metal, and casting defects such as cold shut and blowholes. Additionally, a cooling rate from the die is unstable, and thus it frequently occurs that part of molten metal is not turned amorphous.

Secondly, the high-pressure injection molding method has the following problems. The general high-pressure injection molding method (for example, Japanese Patent Publication No. Hei 10-296424) is capable of molding a subject into a three-dimensional shape by supplementing an insufficient run of spreading of the molten metal by high-pressure injection. However, a formation of a complicated runner as shown in FIGS. 6 to 8 in Japanese Patent Publication No. Hei10-296424 is required in order to obtain a more complicated shape where a boss, a rib and the like are further provided.

Furthermore, in order to reduce the casting defects as described above, there remains a complication where devices such as an air vent (a gas exhausting passage) and an overflow (a waste molten metal tank) have to be elaborately added.

Defective rates due to the casting defects of the die casting are generally assumed to be several percent to several tens of a percent even by using such techniques based on experiences of those who skilled in the art. This indicates that there is no technique by which casting defects can be innovatively prevented in the high-pressure injection molding method.

Thirdly, a melt-forging method has the following problem. In the melt-forging method or the mold-clamp casting method where a molten metal of a metallic glass, which has been arc melted on a water-cooled copper casting mold, then immediately forged and molded. The copper casting mold is water-cooled from a backside so as to prevent a surface of the mold from being heated to a high temperature and being melted at the time of arc-melting.

In locations of a water-cooled portion which make contact with the surface of the mold, melting is insufficient and the metallic glass is not formed. For this reason, locations not suitable for a finished article remain in the molded article, and there is a disadvantage that these parts have to be removed.

In order to avoid this problem, a forging method has been proposed (refer to Japanese Patent Translation 2003-534925). In the method, the mold and a material alloy are heated together to a temperature equal to or more than a melting point of the metallic glass, and then high-speed molding is performed on the material alloy by pressurization, by use of a mold made of silicon Nevertheless, although this forging method is applicable to a simple shape such as a plate material, a cutting process of the mold becomes a problem in applying this method to an article having a complicated three-dimensional shape.

Furthermore, in the melt-forging method, since molding is performed by closing the mold at an instantaneous speed, it is difficult to control a thickness of a molded article with high accuracy in the order of 1 mm or less. Accordingly, there is a critical problem that the method is not easily applicable to a thin-wall or nonuniform-wall molded articles.

Fourthly, a press forming method has the following problem. For example, in Japanese Patent Publication No. Hei10-216920, shown is a method of forming a block-shaped amorphous alloy, which has been heated to a supercooled liquid temperature range, by pressing it against an occluded section of a die placed in a vacuum chamber.

In this method, it is extremely difficult to finish the amorphous alloy into a complicated three-dimensional shape where a boss, a rib, a window frame, a hole and like are provided, in a single time of press forming. Furthermore, since arrangement and removal of a heater and a cooling device are repeated, it is difficult to successively form complicated shapes requiring high measurement accuracy in short cycle times.

Consequently, in order to solve the above described problems, the present inventors advanced experiments and researches by trying various methods. They took into account a point that it is only necessary to mainly manage measurement changes due to thermal expansion and shrinkage because solidification shrinkage does not occur when a metallic glass solidifies as supercooled liquid without crystallizing from the molten metal. Accordingly, they obtained a finding that surface defects can be cleared away in the following manner. Firstly, necessary outline measurements and three-dimensional shape sections are formed by performing pre-forming by die casting in which the injection is performed at a high pressure. Then, warm pressing dies forming a cavity conforming to the outline measurements are prepared. Subsequently, a pre-formed semi-article is arranged between the dies heated to a supercooled liquid temperature range, and warm press forming is performed thereon by pressing with the dies. By this way, material surrounding surface defects remained on a surface of the pre-formed semi-article is filled into the surface defects by means of viscous flow.

In addition, they obtained the following finding. A cavity portion is formed in the warm pressing dies in a manner where the cavity portion has a gap of 1 mm or less. Accordingly, finishing forming in which viscous flow specific to the metallic glass is utilized becomes possible, and this is also suitable for a complicated shape having a nonuniform-wall or a thin-wall in three-dimension.

As a result of further continuing ardent studies based on the findings as described above, the present inventors and others reached completion of the present invention.

SUMMARY OF THE INVENTION

Consequently, the present invention was made in consideration of the above points, and aims to provide a method of forming a metallic glass, which is capable of: forming a formed article, in which no surface defects are generated, by maintaining an amorphous state of the metallic glass; forming a formed component with high measurement accuracy in a simplified processes by using dies whose structures are simple; and easily forming the metallic glass into any one of a formed article having a thin-wall or nonuniform-wall, and a formed article having a complicated shape.

A first aspect of the present invention is to provide a method of forming a metallic glass. The method includes the steps of; molding a metallic glass into a pre-formed semi-article by performing pre-forming by die casting; and then performing a warm press forming on the pre-formed semi-article by heating the pre-formed semi-article to a supercooled liquid temperature range.

In the first aspect of the present invention, a formed article obtained by performing the warm press forming may have a thickness of 1 mm or less.

In the first aspect of the present invention, the pre-forming by the die casting may be performed by ventilating an inert gas.

In the first aspect of the present invention, the metallic glass may be melted by using a YAG laser as a heat source in the pre-forming by the die casting.

In the first aspect of the present invention, the warm press forming may be performed by heating the pre-formed semi-article to the supercooled liquid temperature range in atmosphere.

In the first aspect of the present invention, the heating to the supercooled liquid temperature range may be performed by setting the pre-formed semi-article into dies. A heater is provided inside of the respective dies.

In the first aspect of the present invention, the warm press forming may be performed by heating the pre-formed semi-article to the supercooled liquid temperature range after a powder film for blocking atmosphere is applied to the pre-formed semi-article.

In the first aspect of the present invention, the warm press forming may be performed by heating the pre-formed semi-article to the supercooled liquid temperature range after a surface roughness of the pre-formed semi-article is controlled to be in a range of equal to or more than 0.1 μm and equal to or less than 5 μm in arithmetic average roughness.

In the first aspect of the present invention, the metallic glass may be a zirconium-based metallic glass.

BRIEF DESCRIPTION OF THE DRAWINGS

FIG. 8A is a table showing evaluation results regarding metallic glasses according to Examples 1 to 9 and Comparative Examples 1 to 5, respectively.

FIG. 8B is a table showing evaluation results regarding the metallic glasses according to Examples 1 to 9 and Comparative Examples 1 to 5, respectively.

DETAILED DESCRIPTION OF THE INVENTION

First Embodiment of the Present Invention

Figure 1A:
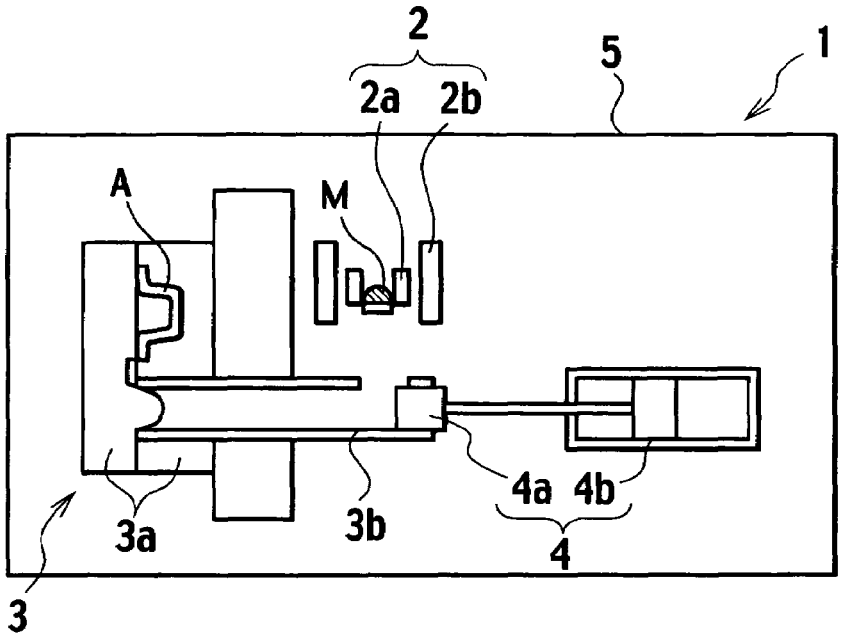
FIG. 1A is a view showing a die casting apparatus used in a pre-forming by die casting method of forming a metallic glass according to a first embodiment of the present invention.

Referring to the drawings, a method of forming a metallic glass according to a first embodiment of the present invention will be described below.

Figure 1B:
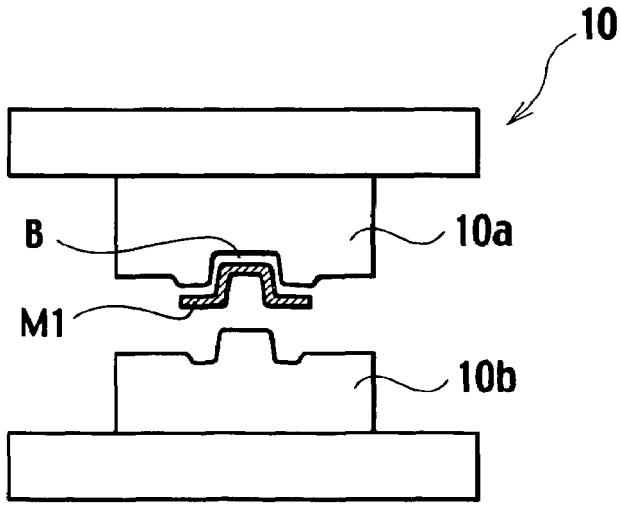
FIG. 1B is a view showing a warm pressing apparatus used in finishing forming by a warm pressing method of forming a metallic glass according to the first embodiment of the present invention.

FIG. 1A shows a die casting apparatus 1 applying the method of forming a metallic glass according to the first embodiment of the present invention. FIG. 1B shows a warm pressing apparatus 10 applying the method of forming a metallic glass according to the first embodiment of the present invention.

The method of forming a metallic glass according to this embodiment is to obtain a formed article made of a metallic glass through the following processes. A pre-formed semi-article is molded by performing pre-forming on the metallic glass by die casting. Warm press forming is performed on the pre-formed semi-article thus molded by heating it to a supercooled liquid temperature range.

As shown in FIG. 1A, the die casting apparatus 1 is schematically configured by appropriately arranging a melting unit 2 for a metallic glass M, a die set 3, and a injection unit 4 inside a die-casting chamber 5.

The melting unit 2 is configured to include a crucible 2*a* and a heater 2*b* arranged around the crucible 2*a* so that the metallic glass M inside the crucible 2*a* can be heated and melted.

The die set 3 is configured to include a die 3*a* and a sleeve 3*b*. The die 3*a* is provided with a cavity A for molding a pre-formed semi-article M1. The sleeve 3*b* communicates with the cavity A via a runner.

The injection unit 4 is configured to include a plunger 4*a* and a piston 4*b*. The plunger 4*a* reciprocates inside the sleeve 3*b*; and the piston 4*b* is a drive source of the plunger 4*a*.

The pre-forming by die casting in the method of molding a metallic glass according to this embodiment is performed as follows. The metallic glass M which has been melted inside the crucible 2*a* is filled into the sleeve 3*b*, and then is filled into the cavity A by pressurization. As a result, the pre-formed semi-article M1 can be molded.

Additionally, as shown in FIG. 1B, the warm pressing apparatus 10 is configured by including an upper die 10*a* and a lower die 10*b*, and is configured in a manner where a cavity B is formed by mold-clamping of the dies 10*a* and 10*b*.

The warm press forming in the method of forming a metallic glass according to this embodiment is performed by heating the pre-formed semi-article M1 to the supercooled liquid temperature range, mounting it in the cavity B of the warm pressing apparatus 10, and then, press-forming it. As a result, a formed article M2 can be formed.

Figure 2A:
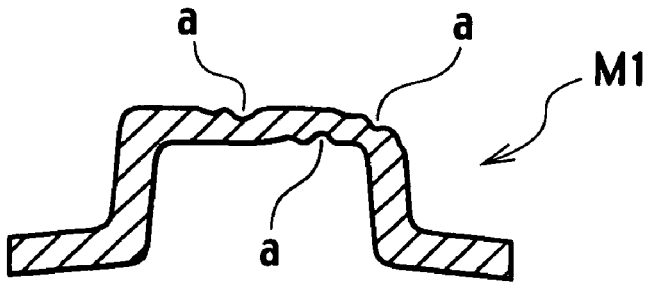
FIG. 2A shows a cross sectional view of a pre-formed semi-article before performing the finishing forming by warm pressing method of forming a metallic glass according to the first embodiment of the present invention.

More specifically, when the pre-formed semi-article M1 molded in the die casting apparatus 1 is warm pressed after having been transferred to the warm pressing apparatus 10, surface defects (casting defects) a such as casting blowholes are filled by means of viscous flow (refer to FIG. 2A), whereby a molded article M2 (refer to FIG. 2B) free from the surface defects a can be obtained.

As described above, the method of forming a metallic glass according to this embodiment reduces the complications of a casting technique, which are acquired by those skilled in the art based on repetitive experiences, as to, for example, providing an appropriate numbers of runners, air vents, and overflows in appropriate positions. For this reason, the method provides a convenience of having the surface defects a cancelled by the warm pressing even if more or less of the surface defects a have remained. Accordingly, structures of dies can also be simple, whereby the reduction in cost for the dies can be pursued.

Note that the die-casting and the warm pressing may be performed respectively in different chambers as shown in FIGS. 1A and 1B, or may be semicontinuously performed in the same chamber.

Additionally, in this embodiment, the warm pressing apparatus 10 may be configured in a manner where a gap in the cavity B becomes 1 mm or less.

Figure 2B:
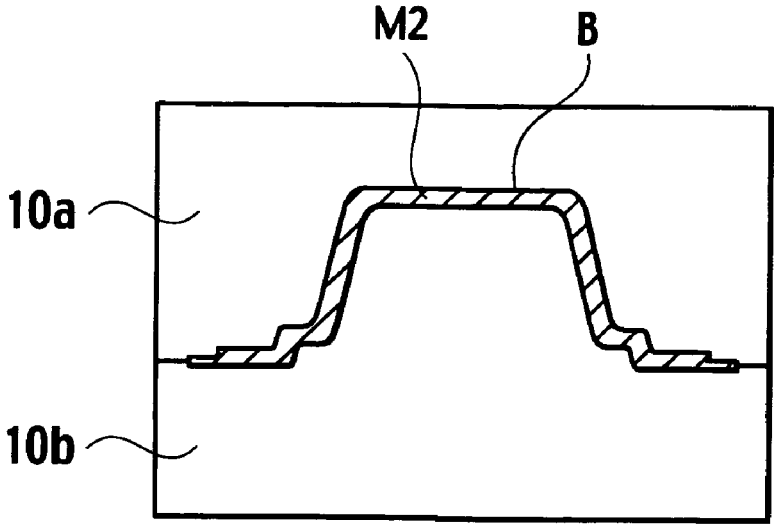
FIG. 2B is a view showing a state of the finish forming by using the warm pressing method of forming a metallic glass according to the first embodiment of the present invention.

According to the configuration as described above of the warm pressing apparatus 10, as shown in FIG. 2B, the formed article M2 is formed by the warm pressing dies 10*a* and 10*b* provided with the cavity B whose gap becomes 1 mm or less. Accordingly, finishing forming, in which viscous flow specific to the metallic glass M is utilized, is sufficiently accomplished. As a result, the configuration can be also suitable for a formed article having a nonuniform-wall or a thin-wall having in three-dimension molded article, and a formed article having a complicated shape.

Additionally, in this embodiment, the pre-forming by die casting may be configured to be performed by ventilating an inert gas.

Figure 3:
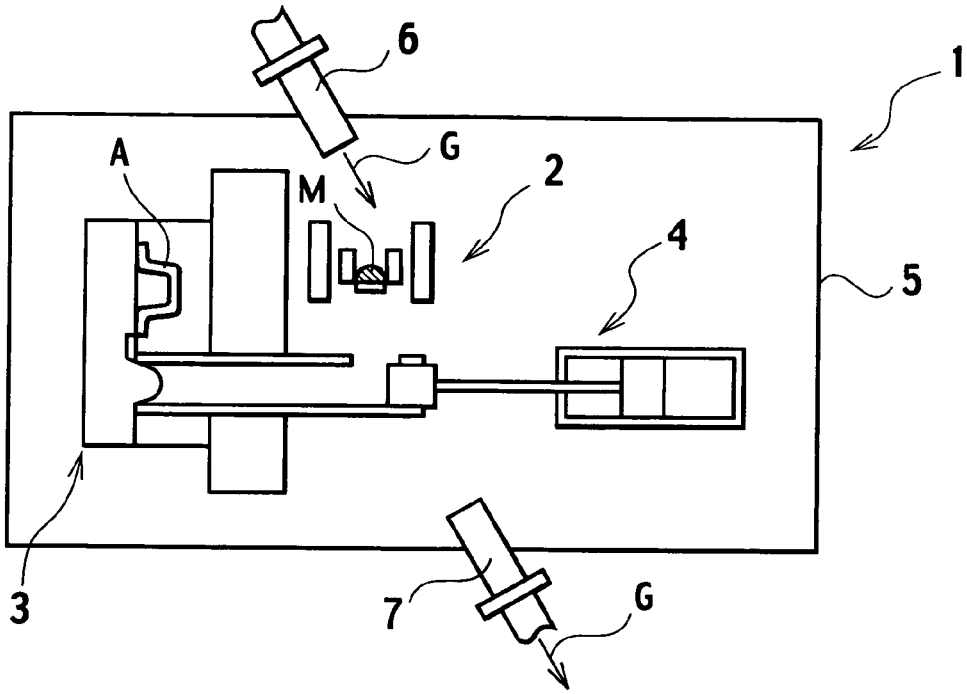
FIG. 3 is a view for explaining the pre-forming by die casting, which is performed by ventilating an inert gas, in the method of forming a metallic glass according to the first embodiment of the present invention.

FIG. 3 indicates a method of carrying out the pre-forming by die casting by ventilating an inert gas G into an inside of the die-casting chamber 5 in FIG. 1A.

That is, the die-casting apparatus 1 is configured by including an inert gas inlet 6 and an inert gas outlet 7 respectively in appropriate locations of the die-casting chamber 5. The die-casting apparatus 1 performs the pre-forming by ventilating the inert gas G into the inside of the die-casting chamber 5 through the inlet 6.

Here, helium, nitrogen, argon or the like is selected as the inert gas G.

The pre-formed semi-article M1 is pushed and released from the die set 3 by an extrusion pin (not illustrated). The pre-formed semi-article M1 is dropped to, and stored in, a repository prepared in a lower place of the inside of the die-casting chamber 5.

According to the configuration of the die casting apparatus 1 as described above, there is no need of reducing a pressure inside the die-casting chamber 5 to a high vacuum level every time the metallic glass M is melted, for which oxidization at the time of melting is not favorable. Thereby, simplification of the processes can be pursued.

At this time, the metallic glass M may be introduced to the inside of the die-casting chamber 5 via a preliminarily evacuated antechamber (not illustrated). In the configuration as described above of the die casting apparatus 1, installation and the pre-forming can be continuously performed on the metallic glass M.

Additionally, the metallic glass M used in the die-casting may be configured to be melted by using a YAG laser L as a heat source in this embodiment.

Figure 4:
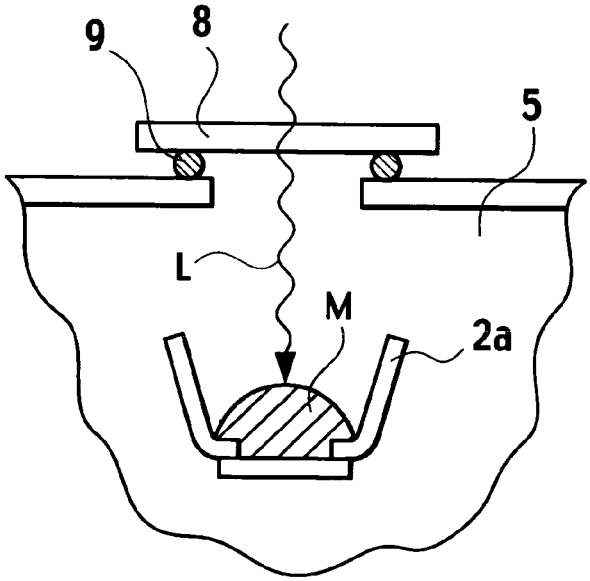
FIG. 4 is a view for explaining the melting of the metallic glass by a YAG laser at the time of pre-forming by die casting method of forming a metallic glass according to the first embodiment of the present invention.

FIG. 4 shows an example where the YAG laser L is used as a melting heat source for the metallic glass M.

An example where the heater 2*b* is provided inside the die-casting chamber 5 is shown in FIG. 1B. However, by providing the melting heat source outside the die-casting chamber 5, a volume of the die-casting chamber 5 can be made smaller and an amount of ventilation of the inert gas can be saved.

In FIG. 4, a component indicated by reference numeral 8 is an inlet window for the YAG laser L and is composed of a transparent glass, and a component indicated by reference numeral 9 is a sealing member.

Here, one reason for using the YAG laser L as the melting heat source for the metallic glass M is that high-energy density beams can be radiated, from an outside of the die-casting chamber 5 via the inlet window 8 made of a transparent silica glass or the like, into the die-casting chamber 5 blocked from the outside air.

Furthermore, also in the case of simultaneously carrying out the pre-forming by using a plurality of the die casting apparatuses 1, the use of the YAG laser L is advantageous. This is because it is possible to efficiently carry out melting in a plurality of locations by the YAG laser L branching from a single laser oscillation apparatus by means of a plurality of optical fibers.

Additionally, the warm press forming is performed by using the warm pressing apparatus 10 shown in FIG. 1B, and heating the pre-formed semi-article M1 to the supercooled liquid temperature range in atmosphere. As a result, finishing in which the viscous flow specific to the metallic glass M is utilized can be accomplished.

The heating to the supercooled liquid temperature range may be configured to be performed on the pre-formed semi-article M1 set in a die inside of which a heater is provided. The warm pressing apparatus 10 having this configuration is shown in FIG. 5.

Figure 5:
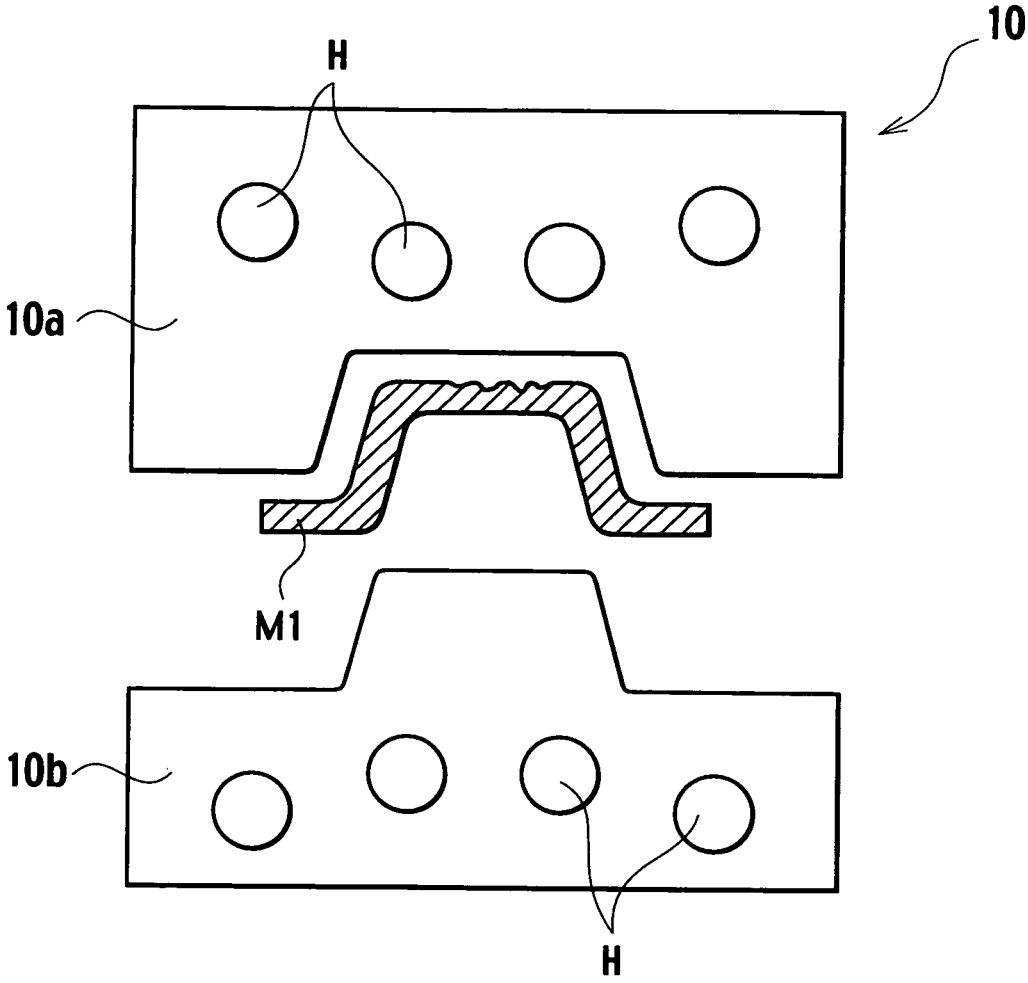
FIG. 5 is a schematic explanatory view of dies including the heaters, used in the warm pressing method of forming a metallic glass according to the first embodiment of the present invention.

The warm pressing apparatus 10 is configured of the upper die 10*a* and the lower die 10*b* inside each of which cartridge heaters H are provided, as shown in FIG. 5.

According to the warm pressing apparatus 10 having the configuration as described above, the pre-formed semi-article M1 can be heated at the time of the warm press forming, and becomes less likely to be influenced by an ambient temperature. For this reason, it becomes possible to continuously carry out the warm pressing only by simple opening and closing operations of the upper die 10*a* or the lower die 10*b*.

Here, the warm pressing may be performed by selecting the inert gas as an ambient atmosphere, or the warm pressing may be performed in atmosphere. In the case of carrying out the warm pressing in atmosphere, an oxide film is formed on a surface of a molding subject. However, the oxide coating film becomes a protective film to prevent oxidation penetration into the inside of the molding subject, and also does not cause crystallization from the surface, by completing the forming until the forming subject crystallizes in a supercooled liquid temperature range.

Figure 6:
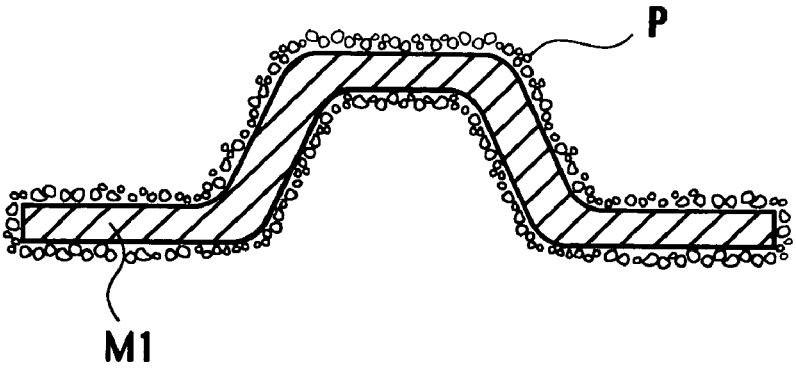
FIG. 6 is a cross-sectional view of the pre-formed semi-article having a powder film applied thereon, to which the warm pressing method of forming a metallic glass according to the first embodiment of the present invention is applied.

Additionally, in this embodiment, the warm press forming may be configured to be performed as follows. A powder film P which blocks atmosphere is applied onto the pre-formed semi-article M1, and then the pre-formed semi-article M1 is heated to a supercooled liquid temperature range. The pre-formed semi-article M1 in this case is shown in FIG. 6.

Here, the powder film P is obtained by applying powder onto a surface of the pre-formed semi-article M1. Note that the present invention is not limited to the case of using BN (boron nitride) as the powder film P. The present invention is also applicable to the case of using a powder film capable of achieving distribution of heat-resisting particles, such as high-density carbon powder or molybdenum disulfide ($MoS_2$).

Additionally, it is not necessary to limit the present invention to the case of using a spray as a method of the application. The present invention is also applicable to the case of using immersion or brush coating.

According to the configuration as described above, the powder film P exists between each of the dies and the pre-formed semi-article M1, and functions as reducing surface friction during the forming. As a result, viscous flow of the pre-formed semi-article M1 is facilitated, whereby the more smooth press forming can be performed.

Figure 7:
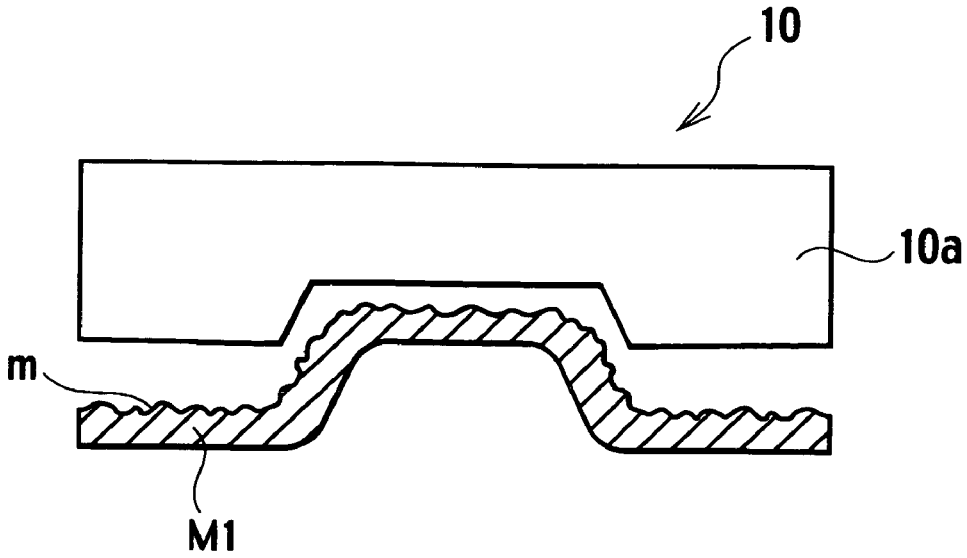
FIG. 7 is a cross-sectional view of the pre-formed semi-article having a controlled surface roughness, to which the warm pressing method of molding a metallic glass according to the first embodiment of the present invention is applied.

Additionally, in this embodiment, the warm press forming may be configured to be performed by heating the pre-formed semi-article M1 to the supercooled liquid temperature range after preparing a surface roughness of the pre-formed semi-article M1 to be in a range of equal to or more than 0.1 μm and equal to or less than 5 μm in arithmetic average roughness (Ra). The pre-formed semi-article M1 in this case is shown in FIG. 7.

Here, the pre-formed semi-article M1 has the surface roughness prepared to be in a range of equal to or more than 0.1 μm and equal to or less than 5 μm in arithmetic average roughness (Ra) by applying a sand blasting treatment onto a surface m.

Note that the present invention is not limited to the case of using the sand blasting for preparing the surface roughness. The present invention is also applicable to the case of using shot blasting in which another projected material is utilized, mechanical grinding, chemical polishing or the like.

Additionally, limiting the surface roughness is because of the following reasons. If the surface roughness Ra is less than 0.1 μm, an effect of reducing a contact area between a die (for example, the upper die 10*a*) and the pre-formed semi-article M1 becomes insufficient, and also an effect of reducing friction does not occur.

On the contrary, if the surface roughness Ra exceeds 5 μm, although the friction is considerably reduced, there is a possibility that locations difficult to be filled in by means of the viscous flow may remain depending on a shape of the pre-formed semi-article M1.

According to the above described configuration, the surface m of the pre-formed semi-article M1 is prepared so as to have the surface roughness within the predetermined range. The surface m functions as reducing the friction by reducing a contact area between the die (for example, the upper die 10*a*) and the pre-formed semi-article M1, and of facilitating the viscous flow of the pre-formed semi-article M1.

Large surface defects of the pre-formed semi-article M1 gradually become smaller by means of the viscous flow along with the progress of the forming, and become completely flat at the time when the forming is completed. Accordingly, there is no possibility that these surface defects adversely affect surface quality of the formed article M2 (refer to FIG. 2B).

According to the method of forming a metallic glass according to this embodiment, a process of warm press forming is performed on the metallic glass being heated to the supercooled liquid temperature range continuously after a process of performing pre-forming on the metallic glass by die casting. Accordingly, material surrounding surface defects remaining on the surface of the pre-formed semi-article at the time of casting is filled into the surface defects by means of the viscous flow, and the surface defects are buried, whereby the defects can be cleared away.

In other words, according to the method of forming a metallic glass according to this embodiment, surface defects remaining on the surface of the pre-formed semi-article M1 having been molded by die casting can be cleared away at the time of successively performing the warm press forming of the metallic glass being heated to a supercooled liquid temperature range. This makes it possible to provide a method of forming a metallic glass, which is capable of forming a formed article in which surface defects are not generated while maintaining an amorphous state of the metallic glass.

Moreover, according to the method of forming a metallic glass according to this embodiment, the surface defects remaining on the surface of the pre-formed semi-article M1 can be cleared away at the time of successively performing the warm press forming. Accordingly, the designing of dies becomes easier, and at the same time, a post process of cutting and removing excess portions after the forming is reduced. This makes it possible to provide a method of forming a metallic glass, which is capable of forming a formed article having high measurement accuracy by simplified processes.

Furthermore, according to the method of forming a metallic glass according to this embodiment, warm press forming is performed along with viscous flow of the metallic glass. This makes it possible to provide a method of forming a metallic glass, which is capable of easily forming a formed article having a thin-wall or nonuniform-wall, and a formed article having a complicated shape.

According to the method of molding a metallic glass according to this embodiment, a formed article is formed by the warm pressing dies 10*a* and 10*b* provided with the cavity B whose gap becomes 1 mm or less. Accordingly, finishing forming in which viscous flow specific to the metallic glass is utilized is sufficiently accomplished. As a result, the method can be also suitable for a formed article having a nonuniform-wall or thin-wall in three dimension and a formed article having a complicated shape.

According to the method of forming a metallic glass according to this embodiment, there is no need of depressing an ambient atmosphere for pre-forming by die casting to a high vacuum level every time the metallic glass is melted.

According to the method of forming a metallic glass according to this embodiment, the YAG laser L is used. For this reason, high-energy density beams are radiated from the outside of the die-casting chamber 5 into the die-casting chamber 5 which is blocked from the outside air. Thereby, the metallic glass M can be melted in the die-casting chamber 5. Moreover, even in the case of simultaneously carrying out the pre-forming by using a plurality of the die casting apparatuses 1, the metallic glass M in a plurality of the die-casting chambers 5 can be simultaneously melted by branching the YAG laser L from a single laser oscillation apparatus by means of a plurality of the optical fibers.

In other words, according to the method of forming a metallic glass according to this embodiment, the melting heat source for the metallic glass M can be set up outside of the die-casting chamber 5 by using the YAG laser L. For this reason, a volume of the die-casting chamber 5 can be made smaller and an amount of ventilation of the inert gas can be saved. At the same time, the metallic glasses M in a plurality of the die-casting chambers 5 can be simultaneously melted by branching the YAG laser L by means of a plurality of the optical fibers. Accordingly, an improvement of fabrication can be pursued.

According to the method of forming a metallic glass according to this embodiment, warm press forming is performed on the pre-formed semi-article M1 heated to the supercooled liquid temperature range in atmosphere. For this reason, finishing in which viscous flow specific to the metallic glass is used can be accomplished.

According to the method of molding a metallic glass according to this embodiment, the warm pressing can be continuously performed only by simple opening and closing operations of any one of an upper die and a lower die with less influence by an ambient temperature.

According to the method of forming a metallic glass according to this embodiment, the powder film P exists between each of the dies and the pre-formed semi-article M1, and functions as reducing surface friction during the forming. As a result, viscous flow of the pre-formed semi-article M1 can be facilitated.

According to the method of forming a metallic glass according to this embodiment, a surface of the pre-formed semi-article M1 is prepared to be in a range of equal to or more than 0.1 μm and equal to or less than 5 μm. Accordingly, a contact area between each of the dies 10*a* and 10*b*, and the pre-formed semi-article M1 at the time of the warm pressing becomes smaller, whereby friction therebetween is reduced. As a result, viscous flow of the pre-formed semi-article M1 at the time of the warm pressing is facilitated.

Additionally, the pre-formed semi-article M1 may be one having the powder film P applied on a surface, whose surface roughness has been prepared. In this case, formation of the powder film P is favorable, and the viscous flow of the pre-formed semi-article at the time of the warm pressing is further facilitated.

According to the method of forming a metallic glass according to this embodiment, after the pre-forming by die casting has been performed by using a zirconium-based metallic glass, the pre-formed semi-article M1 thus obtained is heated to a supercooled temperature range, and then warm press forming is applied to the pre-formed semi-article M1. Accordingly, at the time of the warm press forming, finishing forming in which viscous flow in an extremely wide supercooled temperature range specific to the zirconium-based metallic glass is advantageously utilized can be sufficiently accomplished. Accordingly, surface defects remained on the surface of the pre-formed semi-article at the time of casting can be effectively cleared away.

In other words, according to the method of forming a metallic glass according to this embodiment, at the time of the warm press forming, the finishing forming in which the viscous flow in the extremely wide supercooled temperature range specific to the zirconium-based metallic glass is advantageously utilized can be sufficiently accomplished. As a result, the surface defects remaining on the surface of the pre-formed semi-article M1 at the time of casting can be effectively cleared away. Thereby, a formed article in which surface defects are not generated can be formed while maintaining an amorphous state of the zirconium-based metallic glass.

In FIGS. 8A and 8B, evaluation results regarding formed articles made of metallic glass according to Examples 1 to 9 and Comparative Examples 1 to 5 are shown.

The formed articles made of metallic glass according to Examples 1 to 9 were formed by the above described method of forming a metallic glass according to the first embodiment. Specifically, each of the formed articles made of metallic glass according respectively to Examples 1 to 9 were formed in the following manner. After the pre-forming by die casting was performed on the metallic glass M, the pre-formed semi-article M1 thus obtained was heated to the supercooled liquid temperature range and then the warm press forming was applied to the pre-formed semi-article M1. Die casting conditions and warm pressing conditions in respective Examples 1 to 9 are shown in FIGS. 8A and 8B.

On the other hand, the formed article made of metallic glass according to Comparative Example 1 was formed by a method of forming a metallic glass only by die casting. The formed article made of metallic glass according to Comparative Example 2 was formed by a method of forming a metallic glass in which warm pressing was attempted by using a material previously formed into a plate by melt-forging. The formed article made of metallic glass according to Comparative Example 3 was formed by a method of forming a metallic glass only by permanent mold casting. The formed article made of metallic glass according to Comparative Example 4 was formed by a method of forming a metallic glass only by high-pressure injection molding. The formed article made of metallic glass according to Comparative Example 5 was formed by a method of forming a metallic glass only by melt-forging. Note that forming conditions in Comparative Examples 1 to 5 are also shown in FIGS. 8A and 8B.

Note that the metallic glass used in the Examples 1 to 9 and Comparative Examples 1 to 5 is a zirconium-based metallic glass.

Note that, as shown in FIGS. 8A and 8B, the evaluation was given of the effects regarding "minimum wall thickness of finished article by forming," "surface roughness of finished article," "finished shape (degree of filling)," "presence or absence of surface defect" and "whether or not finished article maintains amorphous state."

Here, "finished shape (degree of filling)" is indicated by "O" in a case where a difference of a measured weight in the finished shape from a weight which can be previously calculated based on a volume and a specific gravity was minus 0.5% or better, or is indicated by "X" in a case where the weight difference exceeding 0.5% occurred.

Additionally, "presence or absence of surface defect" was evaluated by visually determining whether or not there were any points deteriorating a shape of the finished article and a surface state as compared to a designed shape of a die cavity.

Moreover, "determination on whether or not finished article maintains amorphous state" is indicated by "O" in a case where it was determined that an amorphous state was maintained based on a result of analyzing the finished article by an X-ray diffraction method, or is indicated by "X" in a case where crystallization occurred without the amorphous state being maintained.

It is clear from FIGS. 8A and 8B, Examples 1 to 9 all cleared evaluation items for all of the effects, whereas Comparative Examples 1 to 5 all had "X" in finished shape (degree of filling), and "present" in presence or absence of surface defect. Therefore, it can be understood how Examples 1 to 9 are excellent.

More specifically, each of Examples 1 to 9 all had "minimum thicknesses of finished article" smaller than "molded thicknesses" of the corresponding pre-formed semi-article, and had "surface roughness" of the finished article smaller than that at the time of warm pressing. As a result, it can be understood that, by performing the warm press forming, material surrounding surface defects remained on surfaces of the pre-formed semi-articles at the time of casting is filled into the surface defects by means of the viscous flow, the surface defects are buried, and the defects are cleared away.

Additionally, each of Examples 1 and 2 is a three-dimensional cabinet having uniform wall thickness and each of Examples 3 to 9 is a three-dimensional cabinet having nonuniform wall thickness. They, however, all resulted in having cleared the evaluation items for all of the effects. Accordingly, it can be understood that the method of forming a metallic glass according to this embodiment is capable of easily forming a formed article having a thin-wall or a nonuniform-wall in three dimension, and a formed article having a complicated shape.

Additionally, ambient atmospheres at the time of the die-cast molding were: vacuum in Example 1; nitrogen gas in Examples 2 and 6; argon gas in Examples 3, 5 and 7 to 9; and helium gas in Example 4. These examples, however, all resulted in having cleared the evaluation items for all of the effects. Accordingly, it can be understood that all of these inert gasses are applicable.

Additionally, ambient atmospheres at the time of the warm press forming were nitrogen gas in Examples 1 to 7 and atmosphere in Examples 8 and 9. These examples, however, all resulted in having cleared the evaluation items for all of the effects. Accordingly, it can be understood that any one of inert gasses which are represented by nitrogen gas and atmosphere is applicable to the warm press forming.

INDUSTRIAL APPLICABILITY

As described above, according to the present invention, it is possible to provide a method of forming a metallic glass. The method of forming a metallic glass is capable of forming a formed article in which no surface defects are generated while maintaining an amorphous state of the metallic glass. The method is also capable of forming a formed component with high measurement accuracy by simplified processes in which dies having simple structures are used. The method is further capable of easily forming the metallic glass into a thin-wall or nonuniform-wall formed article and a formed article having a complicated shape.

The invention claimed is:

1. A method of forming a metallic glass, comprising the steps of:

molding a metallic glass into a pre-formed semi-article by performing pre-forming by die casting;

applying a powder film for blocking atmosphere to the pre-formed semi-article; and then performing warm press forming on the pre-formed semi-article by heating the pre-formed semi-article to a supercooled liquid temperature range.

2. The method of forming a metallic glass according to claim 1, wherein, a formed article obtained by performing the warm press forming has a thickness of 1 mm or less.

3. The method of forming a metallic glass according to claim 1, wherein, the pre-forming by the die casting is performed in a chamber that is ventilated with an inert gas.

4. The method of forming a metallic glass according to claim 1, wherein, the metallic glass is melted by using a YAG laser as a heat source in the pre-forming by the die casting.

5. The method of forming a metallic glass according to claim 1, wherein, the warm press forming is performed by heating the pre-formed semi-article to the supercooled liquid temperature range in air.

6. The method of forming a metallic glass according to claim 5, wherein, the heating to the supercooled liquid temperature range is performed by setting the pre-formed semi-article into dies, a heater is provided inside of the respective dies.

7. The method of forming a metallic glass according to claim 1, wherein, the warm press forming is performed by heating the pre-formed semi-article to the supercooled liquid temperature range after a surface roughness of the pre-formed semi-article is controlled to be in a range of 0.1 μm or more and 5 μm or less in arithmetic average roughness.

8. The method of forming a metallic glass according to claim 1, wherein, the metallic glass is a zirconium-based metallic glass.

* * * * *